US005967644A

United States Patent [19]

Pan

[11] Patent Number: 5,967,644

[45] Date of Patent: Oct. 19, 1999

[54] DECORATIVE LIGHT STRING SET OF A CURTAINED TYPE

[76] Inventor: Wun Fang Pan, No. 125, La. 99, Pu Din Road, Hsinchu, Taiwan

[21] Appl. No.: 08/972,319

[22] Filed: Nov. 18, 1997

[51] Int. Cl.[6] ..... F21V 21/00

[52] U.S. Cl. ..... 362/249; 362/391; 362/806

[58] Field of Search ..... 362/249, 252, 362/226, 391, 806; 315/185 S, 192

[56] References Cited

U.S. PATENT DOCUMENTS 3,723,723 3/1973 Lerner ..... 362/249
4,965,701 10/1990 Voland ..... 362/252

*Primary Examiner*—Y. Quach
*Attorney, Agent, or Firm*—Rosenberg, Klein & Bilker

[57] ABSTRACT

A curtain type decorative light string set capable of connecting with several independent light strings is provided. The light strings are connected in parallel and use the main electrical wires as a support, to be hung on other objects to prevent the light strings from loosening and thereby ensure that all other bulbs stay lit.

1 Claim, 2 Drawing Sheets

DECORATIVE LIGHT STRING SET OF A CURTAINED TYPE

BACKGROUND OF THE INVENTION

A conventional curtain type decorative light string set is composed of a main electrical wire as a supporting means and a plurality of short light strings which are hung separately from the main wire as shown in FIG. 1, that arrangement forms a decorative light string set forming a curtain of lighting bulbs. The structure of this prior art includes several connecting bulb holders a1 on the main electrical wire to engage with the short light strings to be hung therefrom. Since the short light strings can possibly come loose because of the weight of the strings or can be pulled by accident, those light strings may become unlit. If the connecting bulb holder a1, located near to a plug of this light string set, is broken, it might cause the whole light string set to become unlit, as the bulb holder a1 is connected in series with the bulb holder a.

SUMMARY OF THE INVENTION

The main object of the present invention is to provide an improved curtain type decorative light string set which connects with several independent light strings by connecting wires to connect them in parallel and use the main electrical wires as the support means to be hung on other objects and overcome the drawbacks mentioned for the prior art.

The detailed structure, features, and other advantages of this invention will become apparent from the following detailed description of preferred embodiment when read with reference to the accompanying drawings.

DETAILED DESCRIPTION OF THE PREFERRED EMBODIMENT

Figure 1:
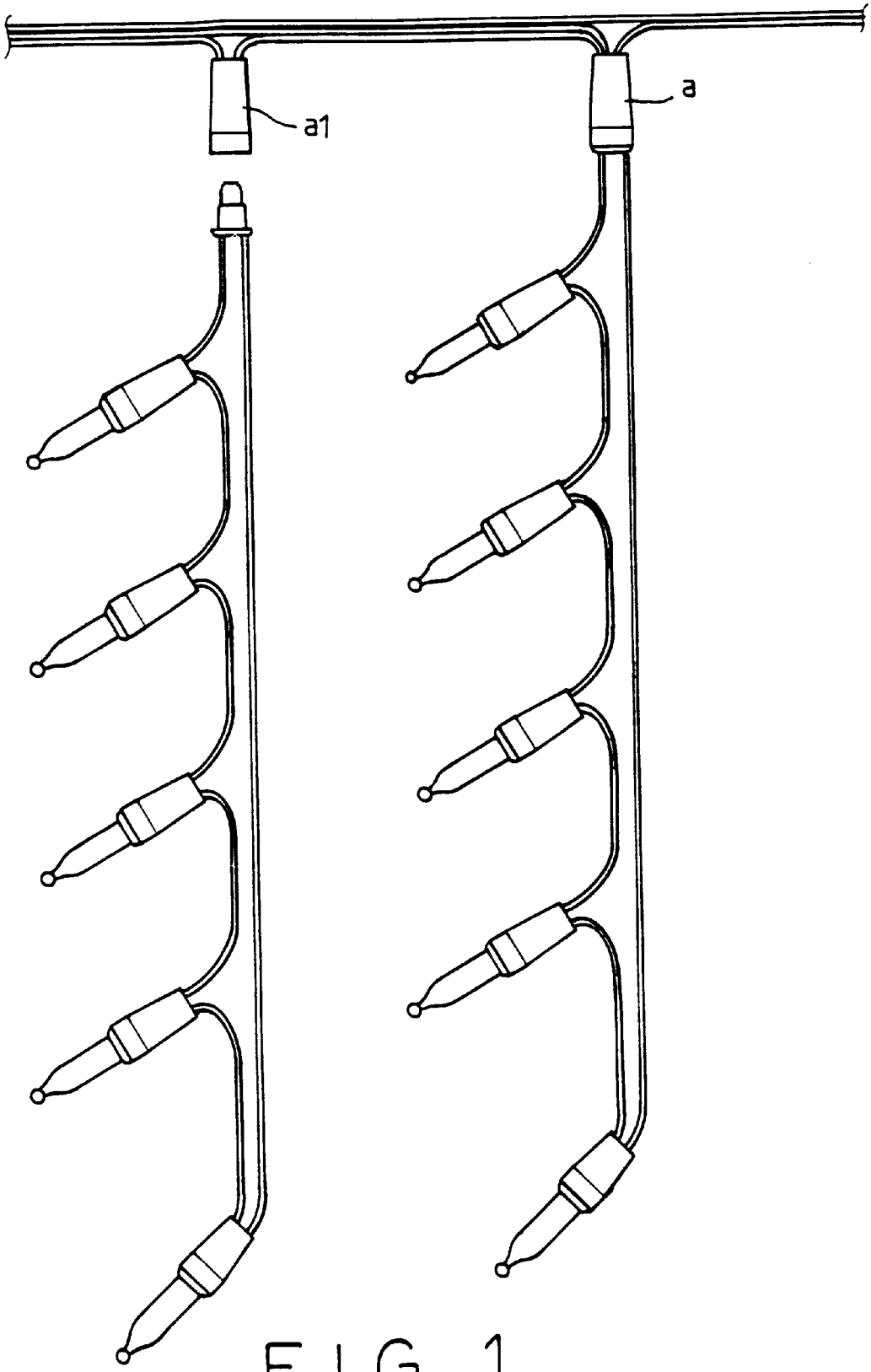
FIG. 1 (prior art)
FIG. 1 is a plan view showing a part of a decorative light string set of a prior art structure; and, FIG. 2 is a schematic illustration showing an embodiment of a decorative light string set of the present invention.
Figure 2:
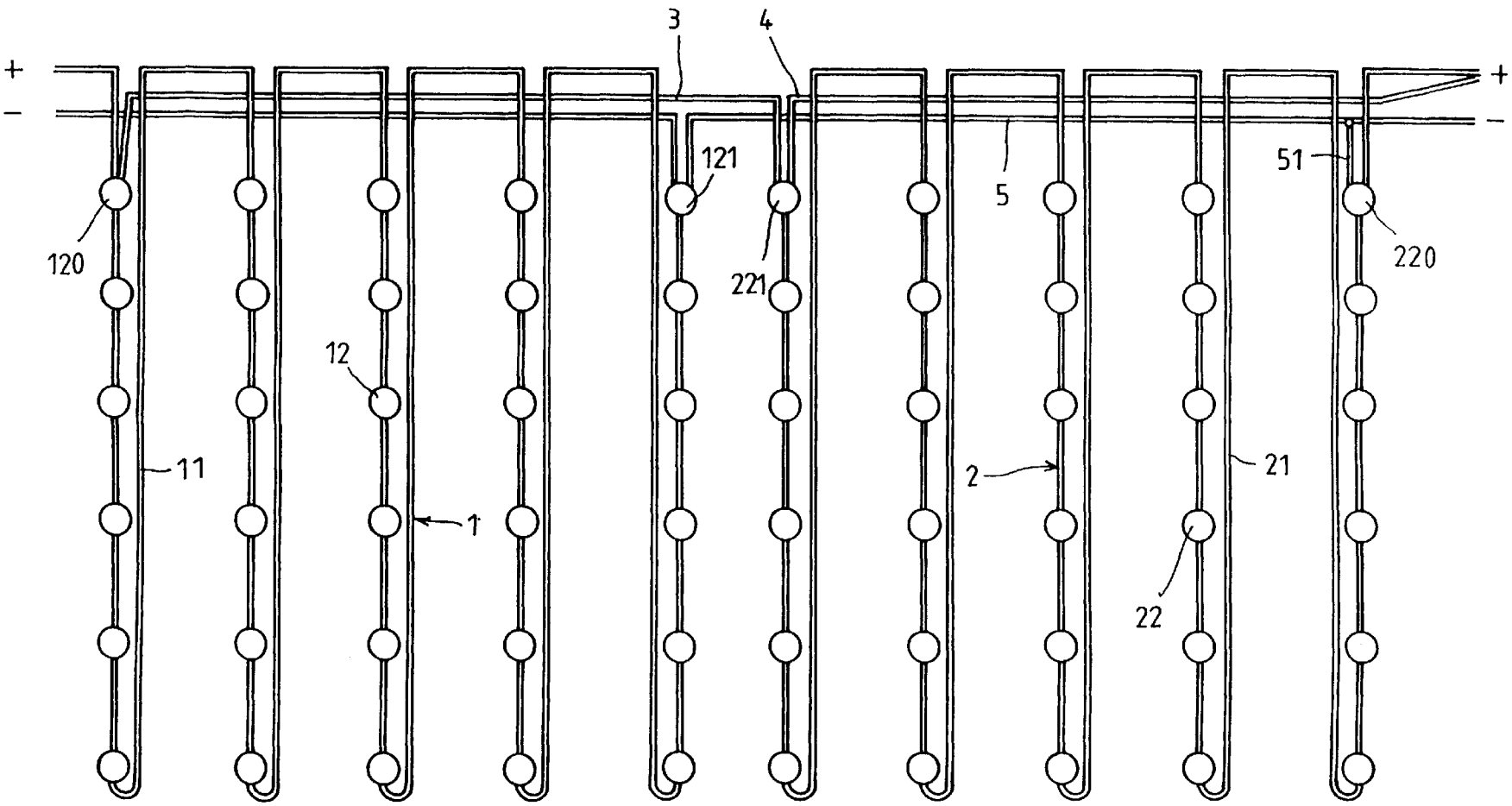

This invention is an improved structure of a curtain type decorative light string set, as shown in FIG. 2. It can be seen from the drawing that the present invention includes two independent light strings, for example. A first light string 1 includes a main electrical wire 11 which connects one end thereof with a positive pole of a power supply and the other end with a negative pole of the power supply, and connects with a plurality of bulbs 12 thereon while the main wire 11 is designed to form a zigzag pattern with several parallel displays. A second light string 2, being similar to the light string 1, includes a main electrical wire 21 connecting with several bulbs 22. The last bulb 221 on the second light string 2 connects with one end of a first connecting wire 3, the other end of which connects with the first bulb 120 on the first light string 1. The last bulb 221 on the second light string 2 connects with one end of a second electrical wire 4. The other end of wire 4 connects with the main wire 21 at the positive pole of the power supply. A third electrical wire 5 is provided to connect with the last bulb 121 on one end thereof and connects with a negative pole of the power supply for the second light string 2 at the other end, which end also connects a fourth wire 51 that extends to connect with the first bulb on the second light string 2.

When assembled in accordance with aforesaid description, the light strings 1, 2 are operated independently and they are accompanied by three electrical wires 3, 4 and 5 which are connected to the light strings in parallel to ensure other bulbs on light strings will be lit whenever a bulb is broken. Moreover, main wires 11 and 21 are arranged in a zigzag pattern to be on other objects, to form a curtain of bulbs while all of the bulbs are connected on the wires that prevent the bulbs from loosening, as in a prior art structure. It can be understood that a third light string is capable of being added and connected together in similar manner for extended utility.

I claim:

1. A curtain type decorative light string set consisting of two light strings, wherein a first light string includes a first main electrical wire, two ends of the first main electrical wire being respectively connected to two poles of a power supply, the first main electrical wire being formed in a zigzag pattern and connected to a plurality of first bulbs that are positioned in parallel; a second light string includes a second main electrical wire arranged in a zigzag pattern and connected to a plurality of second bulbs that are positioned in parallel;

a first connecting wire being provided to connect one end thereof to a last bulb of the plurality of second bulbs of the second light string and an opposing end to a first bulb of the plurality of first bulbs of the first light string;

a second connecting wire being provided to connect one end thereof to the last bulb of the plurality of second bulbs of the second light string and an opposing end to a positive pole of a power supply;

a third connecting wire being provided to connect one end thereof to a last bulb of the plurality of first bulbs of the first light string and an opposing end to a negative pole of the power supply, the third connecting wire also connecting with one end of a fourth wire, the opposing end of the fourth wire being connected to a first bulb of the plurality second bulbs of the second light string; and the first and second main electrical wires being hung on other objects as a means of support.

* * * * *